US005961322A

United States Patent [19]

Coble

[11] Patent Number: 5,961,322

[45] Date of Patent: Oct. 5, 1999

[54] WATER COOLED INNER COVER FOR ANNEALING FURNACE

[76] Inventor: Gary L. Coble, R.D.#2, Box 214, DuBois, Pa. 15801

[21] Appl. No.: 09/080,034

[22] Filed: May 15, 1998

Related U.S. Application Data

[60] Provisional application No. 60/046,556, May 15, 1997.

[51] Int. Cl.[6] ..... F27D 1/12

[52] U.S. Cl. ..... 432/238; 432/206; 432/260; 432/233; 266/263

[58] Field of Search ..... 432/233, 173, 432/260, 254.1, 254.2, 206, 238; 266/263, 259, 262, 252; 373/75, 76, 113, 155, 56, 37

[56] References Cited

U.S. PATENT DOCUMENTS

| | | | |
|---|---|---|---|
| 2,439,127 | 4/1948 | Dailey, Jr. et al. | 230/209 |
| 2,479,102 | 8/1949 | Dailey, Jr. | 263/40 |
| 2,479,814 | 8/1949 | Cone | 263/42 |
| 3,034,776 | 5/1962 | Hennenberger et al. | 263/33 |
| 3,159,387 | 12/1964 | Campbell, Jr. et al. | 263/40 |
| 3,314,668 | 4/1967 | Rosenak | 266/32 |
| 3,366,163 | 1/1968 | Scharbrough | 165/1 |
| 3,429,370 | 2/1969 | Blackman | 165/47 |
| 3,580,331 | 5/1971 | Wargo | 165/48 |
| 3,581,810 | 6/1971 | Blackman | 165/2 |
| 3,652,070 | 3/1972 | Sagara | 266/32 |
| 3,860,222 | 1/1975 | Tennenhouse | 266/5 |
| 4,132,852 | 1/1979 | Andoniev et al. | 13/32 |
| 4,287,940 | 9/1981 | Corbett, Jr. | 165/48 |
| 4,310,302 | 1/1982 | Thekdi et al. | 432/205 |
| 4,443,188 | 4/1984 | Buhler | 432/233 |
| 4,445,852 | 5/1984 | Corbett | 432/260 |
| 4,453,253 | 6/1984 | Lauria et al. | 373/74 |
| 4,502,671 | 3/1985 | Omura | 266/256 |
| 4,516,758 | 5/1985 | Coble | 266/263 |
| 4,611,791 | 9/1986 | Coble | 266/263 |
| 4,755,236 | 7/1988 | Coble | 148/13 |
| 5,048,802 | 9/1991 | Coble | 266/263 |
| 5,142,999 | 9/1992 | Etemad et al. | 110/235 |
| 5,230,617 | 7/1993 | Klein et al. | 432/233 |
| 5,289,495 | 2/1994 | Johnson | 373/74 |
| 5,562,879 | 10/1996 | Coble | 266/252 |
| 5,575,970 | 11/1996 | Coble | 266/44 |
| 5,578,264 | 11/1996 | Coble | 266/263 |
| 5,681,525 | 10/1997 | Coble | 266/44 |
| 5,756,043 | 5/1998 | Coble | 266/44 |

*Primary Examiner*—Teresa Walberg
*Assistant Examiner*—Jiping Lu
*Attorney, Agent, or Firm*—David A. Burge

[57] ABSTRACT

An annealing furnace inner cover cooperates with a furnace base to define a treatment chamber within which a charge of metal such as steel is housed for annealing, wherein the inner cover carries at least one interior cooling conduit through which cooling water from an exterior source is circulated to expedite the cooling of gas that is circulated within the treatment chamber during cooling portions of an annealing cycle. The water cooled inner cover is especially well suited for expediting the cooling of stacked coils of steel sheet from an annealing temperature, and preferably utilizes a helix of cooling coils that surround mid-height portions of the stack, wherein the cooling coils are protectively housed within an inwardly facing recess defined by an enlarged diameter mid-height portion of the inner cover both to prevent cooling coil damage due to impact during cover movement, and to ensure that gas circulation within the inner cover is not adversely restricted by the presence of the cooling coils.

30 Claims, 3 Drawing Sheets

WATER COOLED INNER COVER FOR ANNEALING FURNACE

REFERENCE TO PROVISIONAL APPLICATION

This application claims the benefit of U.S. Provisional Application Ser. No. 60/046,556 entitled WATER COOLED INNER COVER FOR ANNEALING FURNACE filed May 15, 1997 by Gary L. Coble, the disclosure of which is incorporated herein by reference.

BACKGROUND OF THE INVENTION

1. Field of the Invention

The present invention relates generally to the provision and use of an annealing furnace inner cover which cooperates with a furnace base to define a treatment chamber within which a charge of metal such as steel is housed for annealing, wherein the inner cover carries at least one interior cooling conduit through which cooling water from an exterior source is circulated to expedite the cooling of gas that is circulated within the treatment chamber during cooling portions of an annealing cycle. The present invention is especially well suited for expediting the cooling of stacked coils of steel sheet from an annealing temperature, and preferably utilizes a helix of cooling coils that surround mid-height portions of the stack, wherein the cooling coils are protectively housed within an inwardly facing recess defined by an enlarged diameter mid-height portion of the inner cover both to prevent cooling coil damage due to impact during cover movement, and to ensure that gas circulation within the inner cover is not adversely restricted by the presence of the cooling coils within a gas circulation space that separates the interior of the inner cover from the cylindrical outer surfaces of the stacked coils.

2. Prior Art

Annealing furnaces are well known that employ one or more inner covers to surround a stack or stacks of coils of sheet steel during annealing of the stacked coils. Each stack of coils typically is carried atop a round, upwardly facing base structure having an outer diameter that is at least slightly larger than the largest coil diameter of the stack. Each inner cover typically has an upstanding, generally cylindrical side wall closed at its upper end by a top structure, and has a depending, rim-like bottom lip configured to engage a gas impervious seal that extends circumferentially about the base structure. By this arrangement, the base and the inner cover cooperate to define a treatment chamber wherein the character of gas that is circulated therein during annealing can be controlled to maintain a nonoxidizing atmosphere to prevent deleterious effects such as the formation of oxide scale on the coils of steel sheet.

While many patents disclose annealing furnace features of the type just described, the disclosures of the following patents of Gary L. Coble provide good examples thereof, and their disclosures are accordingly incorporated herein by reference: U.S. Pat. Nos. 4,516,758; 4,611,791; 4,755,236; 5,048,802; 5,562,879; 5,575,970; 5,578,264; and, U.S. Pat. No. 5,681,525. Reference also is made to Gary L.Coble's U.S. Pat. No. 5,756,043 scheduled to issue May 26, 1998. These nine patents are collectively referred to later herein as the "Annealing Furnace Patents."

Annealing furnaces are expensive units which need to have their productivity maximized by being loaded promptly when ready for use, by being put through annealing cycles that are conducted efficiently so as to minimize their length, and by being unloaded promptly when annealing cycles are completed—so that, between occasions when furnace "down time" is required to service, rebuild or replace base components and the like, a maximum tonnage of metal can be annealed. To minimize furnace "down time," movable components such as inner covers need to be durable and capable of occasionally sustaining reasonable impacts when being moved about; and, inner covers should not be provided with interior structures (such as inwardly projecting cooling conduits) that are likely to be damaged due to impact as inner covers are lowered to surround, and are raised from surrounding, charges of metal supported atop annealing furnace bases.

Furnace productivity can be maximized if cycle time can be shortened so that a larger number of annealing cycles that can be carried out in a given period of time. Since a sizable portion of each annealing cycle is consumed by "cooling time" (i.e., a number of hours required for a charge of metal that has been heated to an annealing temperature of typically about 1300 to about 1500 degrees Fahrenheit to cool back to near-ambient temperature), the desirability of diminishing the required cooling time has long been recognized. A brisk flow of cooling gas typically is circulated within the treatment chamber to carry heat energy away from the metal charge, and some heat exchange mechanism may be employed to expedite the withdrawal of heat energy from the circulating gas. The more efficiently that heat energy can be removed from the gas, the more effective the circulating gas will perform in withdrawing heat energy from the metal charge, and the shorter will be the resulting cooling time of the annealing cycle.

Ducting cooling gas outside a treatment chamber to be cooled using a heat exchanger before being returned to the treatment chamber has been proposed, as is disclosed in such U.S. Pat. Nos. 2,479,815 and 3,366,163. Providing cooling devices situated inside inner covers also has been proposed: in U.S. Pat. Nos. 2,439,127 and 2,479,102, for example, cooling units are shown connected to the closed upper end regions of inner covers, with cooling coils being provided inside the covers' upper end regions; and, in U.S. Pat. No. 3,581,810, conductive cooling at opposite ends of coils is presented as another option for diminishing cooling time. None of these proposals have gained broad industry acceptance.

The most widely accepted cooling proposal which currently is in use in industry calls for "in base" forced water cooling of the gas that is circulated within inner covers, as is disclosed in such U.S. Pat. Nos. 3,429,370; 4,287,940; 4,310,302; and 4,445,852. This cooling technique utilizes cooling conduits interposed among massive metal base components that must be capable not only of supporting the weight of a stack of steel sheet coils but also of withstanding the enormous thermal shock and violent "steam lock" shock that results when the cooling conduits (which are "dry" while being heated to the annealing temperature during the heating portion of an annealing cycle) are flooded with cooling water at the initiation of the cooling portion of the annealing cycle.

The shock experienced by massive metal base components, by adjacent refractory members, by other base-associated components such as base-carried cooling fans, and by the cooling conduits themselves often dramatically shortens the service life of annealing furnace bases, and may significantly increase furnace "down time" and operating costs due to the need for frequent base maintenance and replacement of prematurely failed components. Accordingly, even this most widely accepted forced water cooling approach has been implemented in only a fraction of the annealing furnaces in present-day use.

The foregoing and other shortfalls of prior forced water cooling proposals, taken together with the sizable costs associated with providing economic supplies of cooling water and the costs incurred in maintaining coolant supply and return plumbing in an impact-likely environment have caused the use of forced water cooling to be restricted to less than half of the annealing furnaces in present use in North America even though it has been shown that the use of forced water cooling can significantly diminish the lengths of cooling portions of annealing cycles, in some instances by half.

SUMMARY OF THE INVENTION

In accordance with the preferred practice of the present invention, at least one interior cooling conduit is supported to extend along interior wall surface portions of an annealing furnace inner cover which cooperates with a furnace base to define a treatment chamber within which a charge of metal such as steel is housed for annealing, and cooling water is circulated through the cooling conduit to expedite the cooling of nonoxidizing gas that is circulated within the treatment chamber during cooling portions of an annealing cycle.

In preferred practice, the present invention utilizes a bell-shaped inner cover that is configured to be lowered into place about a stack of coils of sheet steel supported atop an annealing furnace base. The coils of sheet steel each have a generally cylindrical outer surface and a pair of opposed, substantially flat side surfaces that extend substantially horizontally, and the coils are arranged substantially concentrically one atop another when stacked, with convector plates preferably inserted between adjacent coil side surfaces to facilitate gas circulation therebetween. At least one mid-height region of the inner cover has an enlarged diameter configured to define an inwardly facing recess within which a helical arrangement of cooling conduit coils is supported to circumferentially surround mid-height portions of the stack. The positioning of the helix of cooling conduit coils within the inwardly facing recess serves both 1) to protectively nest the cooling conduit coils to prevent their being damaged due to impacts with the stack of sheet steel coils that otherwise easily could result during normal cover movement, and 2) to ensure that the cooling conduit coils do not project into a gas circulation space that surrounds the cylindrical outer surfaces of the stacked coils. By this arrangement, the cooling conduit coils are protected from contact with the steel mass being treated, and are ideally positioned to provide cooling at a mid-height location of the stack without interfering with proper circulation of cooling gas.

By utilizing a cover-carried water cooling system that requires no provision for "in base" cooling, the disadvantages associated with "in base" cooling are side stepped. Better gas circulation through bases (and hence throughout the treatment chamber defined by a base and its associated inner cover) can be achieved for ducting and directing flows of cooling gases from centrally located, base-carried blowers because gas flows through base passages do not need to be restricted or obstructed by the presence of base-carried cooling conduit coils. Better, stronger, more durable bases can be provided at lower costs because base constructions do not need to be weakened or intricately configured to permit the inclusion of base-carried cooling conduits. Base service life is significantly enhanced by the elimination of accelerated deterioration and frequent failure of base components due to thermal shock and to "steam lock" shocks which result when cooling conduits are flooded with water as an annealing cycle moves from its heating phase to its cooling phase.

Moreover, several advantages obtain from utilizing forced water cooling conduit coils that are carried by the inner cover rather than incorporated into a furnace base. The positioning of cooling conduit coils within inner covers at mid-stack heights and in orientations extending closely about circumferential portions of a stack of sheet steel coils provides enhanced cooling efficiency over that which is achieved when cooling conduits are located more remotely as with "in base" placements. Also, when a furnace base needs to be repaired, rebuilt or replaced, this work is rendered less complex, less time consuming, and less expensive because there no longer exists a need to deal with repair or replacement of base-carried cooling conduits and associated plumbing. When cooling coil repair or replacement is required, it is not necessary to take a furnace base out of service for this purpose; rather, the inner cover that carries a cooling conduit which needs service is simply replaced (during the time needed for such service) by bringing into service a substitute interchangeable inner cover—whereby furnace "down time" due to cooling conduit service is substantially eliminated.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
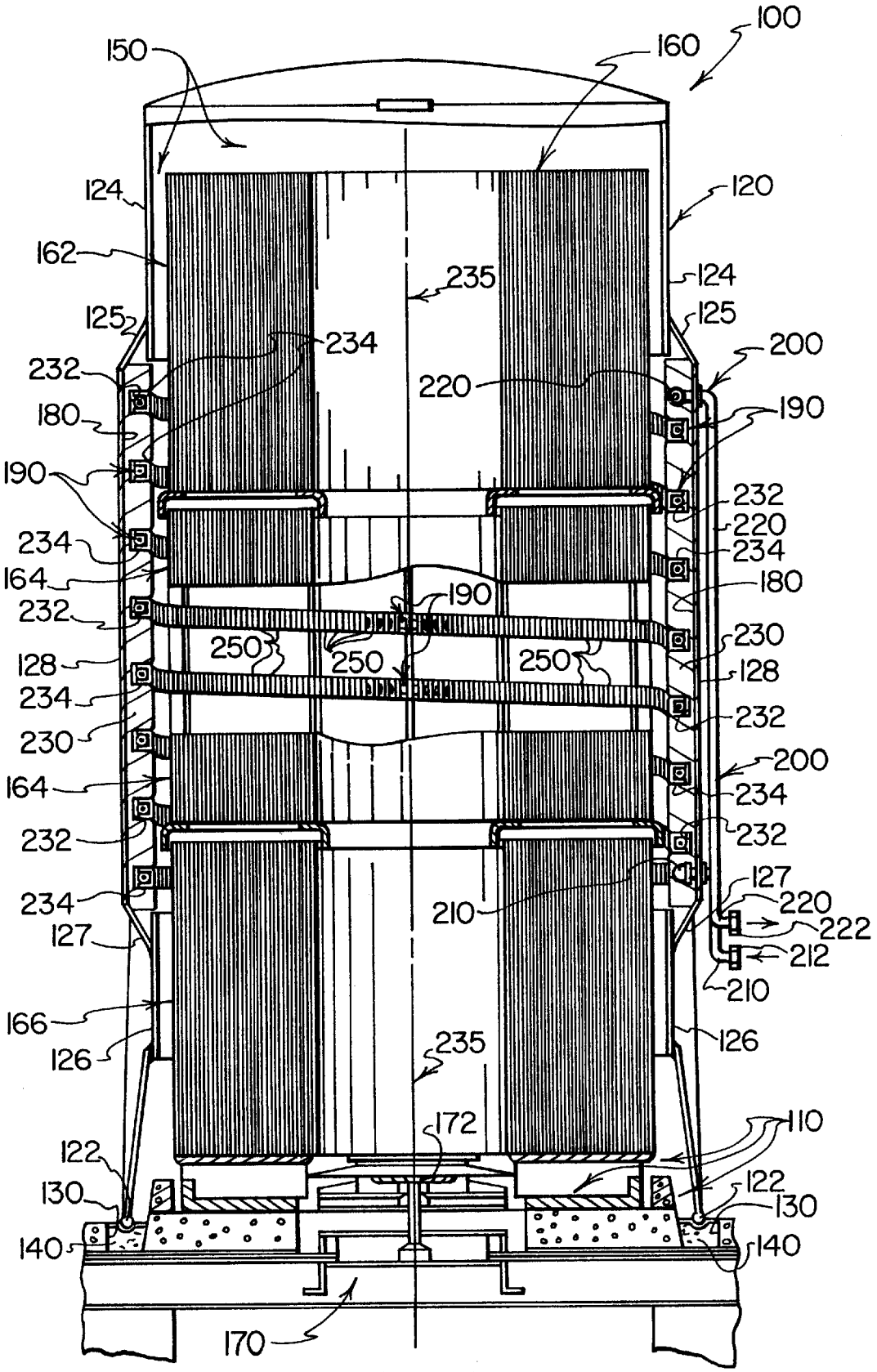
FIG. 1 is a sectional view showing an annealing furnace base supporting a vertical stack of coils of sheet steel, with a bell-shaped inner cover that embodies the best mode known for carrying out the preferred practice of the present invention surrounding the stack and cooperating with the base to define a treatment chamber wherein a nonoxidizing atmosphere may be maintained during an annealing process, with mid-stack portions of one of the sheet steel coils being broken away to permit features of the inner cover to be seen including cooling conduit coils that are arranged to define a vertically extending helix, with the cooling conduit coils being protectively nested within in an inwardly-facing recess defined by enlarged diameter mid-height portions of the inner cover.

Referring to FIG. 1, selected portions of an annealing furnace 100 include a generally round base assembly 110 and a downwardly-opening, generally cylindrical (i.e., "bell shaped") inner cover 120. An upwardly opening inner seal trough 130 extends circumferentially about the base assembly 110 and carries a seal 140 that is compressively engaged by a depending rim 122 of the inner cover 120 when the inner cover 120 is seated atop the inner seal 140.

As those who are familiar with annealing furnace operation will readily understand, it is the function of the inner seal 140 to cooperate with the depending rim 122 of the inner cover 120 to maintain a closed, controlled-environment treatment chamber 150 within the confines of the inner cover 120. Within the treatment chamber 150 a charge of metal 160 (typically comprising a stack of three coils 162, 164, 166 of steel sheet arranged with their substantially flat side surfaces extending horizontally, with the coils 162, 164, 166 arranged concentrically one atop another, and with adjacent pairs of coil side surfaces separated by convector plates 168 that preferably are of a type described in U.S. Pat. No. 5,048,802 of Gary L. Coble) is supported atop the base assembly 110 for annealing.

A positive pressure, non-oxidizing atmosphere typically is maintained within the treatment chamber 150 while a furnace chamber (not designated by a numeral.) which encloses the inner cover 120 is heated by a surrounding furnace structure (not shown) to bring the treatment chamber 150 to a desired elevated annealing temperature, whereafter controlled cooling of the charge of metal 160 is permitted to take place to bring the charge of metal 160 back to near ambient temperature before the furnace 100 is "opened" and the charge of metal 160 removed. A fan 170 having a rotary impeller 172 is disposed centrally among components of the base assembly 110 for circulating non-oxidizing gases within the closed environment of the treatment chamber 150. The temperature of the gases that are circulated within the treatment chamber 150 typically is elevated to between about 1300 to about 1500 degrees Fahrenheit for a period of time sufficient to heat and treat the charge of metal 160, and then is cooled back to near ambient temperature to complete an annealing process, whereafter the inner cover 120 is removed by a crane to permit the charge of metal 160 to be unloaded from the base assembly 110 so that a new charge of metal (not shown) can be loaded onto the base assembly 110 to initiate the next annealing cycle.

The furnace base portions depicted in FIG. 1 one of the base assemblies 110 and only one of the inner covers 120, or may belong to a "plural stack" furnace which employs a plurality of the base assemblies (not shown) arranged in a spaced array for use with a corresponding number of the inner covers 120. Features of annealing furnaces that utilize base assembly portions such as those indicated by the numeral 110 in FIG. 1 are described in greater detail in the above-referenced Annealing Furnace Patents of Gary L. Coble.

Figure 2:
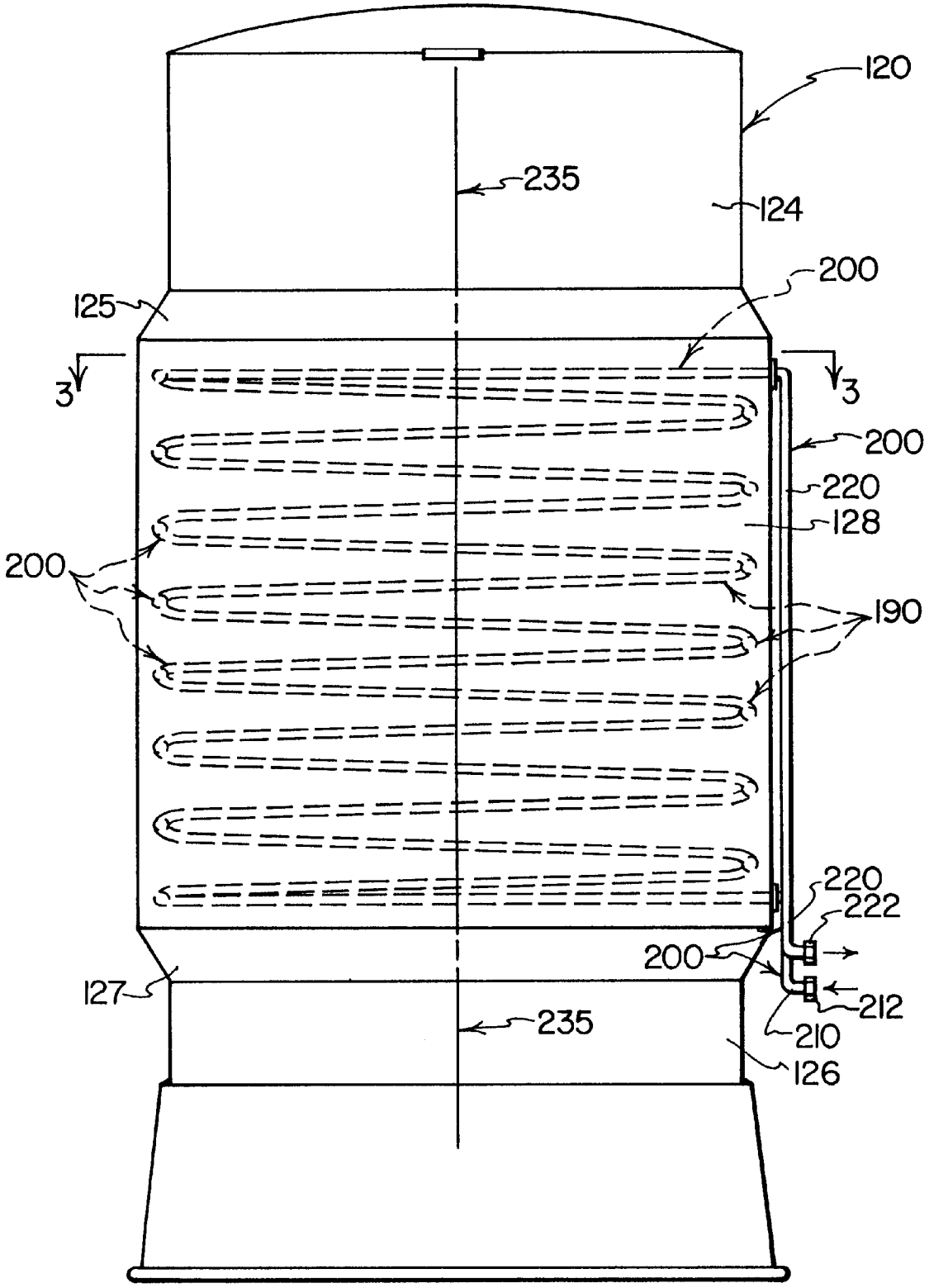
FIG. 2 is a side elevational view of the inner cover, with broken lines being provided to illustrate the location and arrangement of the cooling coil helix and its opposite inlet and outlet ends which extend through the wall of the inner cover to permit cooling water from an external source (not shown) to be supplied to and circulated through the cooling coil helix; and, FIG. 3 is a sectional view as seen from a plane indicated by a line 3—3 in FIG. 2.

Referring to FIGS. 1 and 2, the inner cover 120 has upper and lower, generally cylindrical end regions 124, 126, respectively, that are of a substantially equal first diameter; and a central mid-height portion 128 that is of a greater second diameter. Oppositely tapered upper and lower truncated conical transitions 125, 127 are provided to connect the upper end region 124 and the lower end region 126 with the central portion, respectively. By this arrangement, it will be seen that the enlarged diameter central region 126 of the inner cover 120 defines what can be said to constitute an inwardly facing recess 180 within which a helix of cooling conduit coils 190 can be supported and protectively nested—without causing the cooling conduit coils 190 to exhibit an inner diameter that is smaller than the inner diameters of the upper and lower end regions 124, 126, hence the flow of circulating gases about the circumference of the stack of coils 160 is not restricted or inhibited by the presence of the cooling conduit coils 190 because a gas flow circulation space is maintained between all elements of the generally cylindrical interior of the inner cover 120 (including the cooling conduit coils 190 and their supports, described shortly) and the generally cylindrical exteriors of the stacked coils 162, 164, 166.

Referring to FIG. 2, the helical arrangement of the cooling conduit coils 190 is depicted in hidden lines—which illustrate that the coils 190 preferably comprise an in-series arrangement of coils defined by a single cooling conduit 200. A lower end portion of the conduit 200 projects through the central wall portion 128 near its lower end and defines an inlet pipe 210 that carries a fitting 212 for connection to source of relatively cold pressurized cooling water (not shown). An upper end portion of the conduit 200 projects through the central wall portion 128 near its upper end and defines an outlet pipe 220 that carries a fitting 222 for returning heated cooling water to the source (not shown) for recirculation after heat energy has been extracted therefrom.

Figure 3:
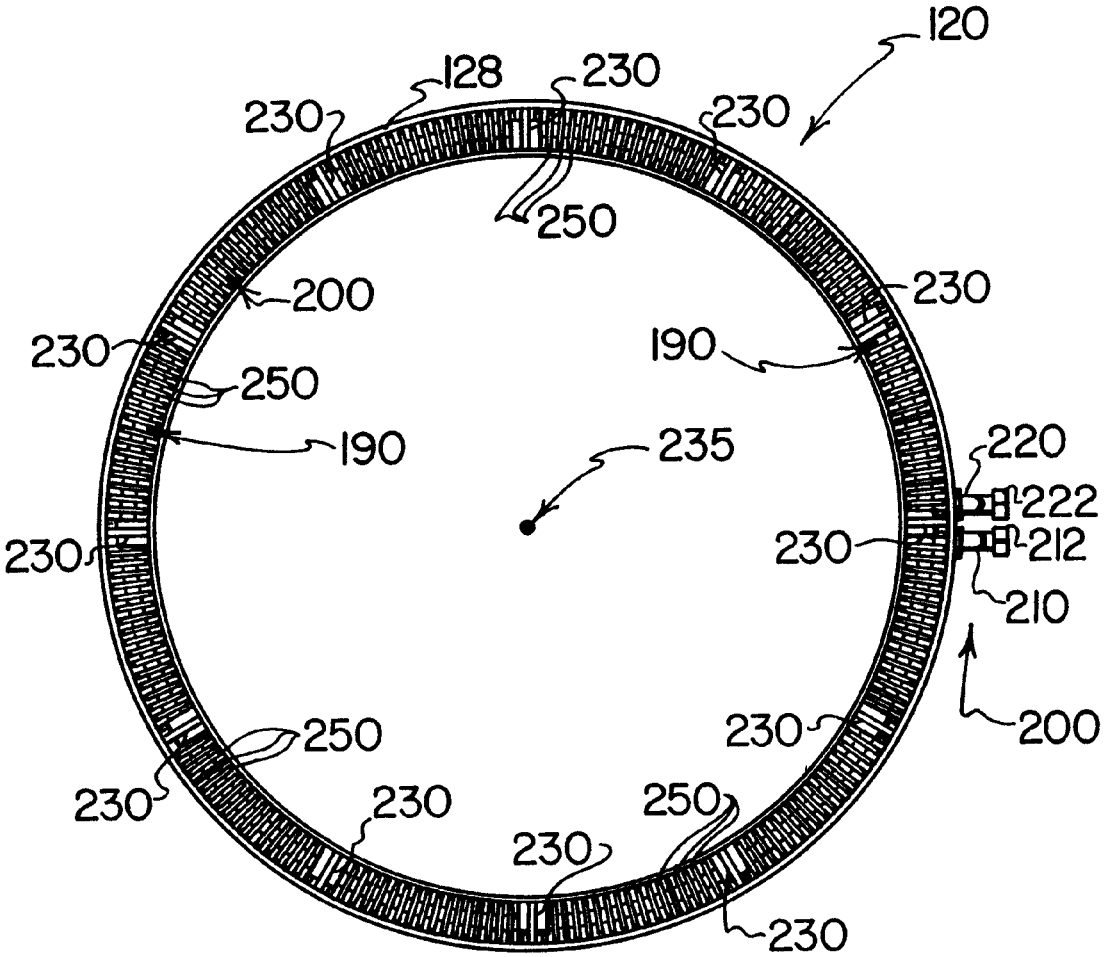

Referring to FIGS. 1 and 3, vertically extending cooling coil support bars 230 are provided at twelve equally spaced locations about the inner diameter of the central wall portion 128, with each of the support bars 230 having a generally rectangular cross-section (as is best seen in FIG. 3) that is oriented so as to extend radially with respect to a vertically extending central axis of the inner cover, which is designated by a "dot" 235 in FIG. 3, but which is indicated by centerlines 235 in FIGS. 1 and 2. The support bars 230 not only serve to securely support the coils 190 of the cooling conduit 200 but also aid in protecting the coils 190 from impact with the stacked sheet steel coils 162, 164, 166 when the inner cover 120 is raised, lowered, or otherwise repositioned.

Referring to FIG. 2 wherein two of the coil support bars 230 are shown in profile, inwardly-facing, generally U-shaped notches 232 are provided in the support bars 230 to receive and support the coils 190. C-shaped retainers 234 are provided to close the notches 232 to retain the coils 190 within the notches 232. By this arrangement, and by virtue of there being a total of twelve of the appropriately notched coil support bars arranged at equally spaced intervals on the interior side of the central wall portion 128, the coils 190 are quite securely connected to the inner cover 120 and retained within the inwardly-facing recess 180.

Referring to FIGS. 2 and 3, fins 250 preferably are provided at substantially regularly spaced intervals along the lengths of the coils 190. About three of these fins per inch are preferred—by which arrangement, the effective surface area of the coils 190 (as seen by cooling gases that are circulated within the treatment chamber 150) is significantly increased to enhance the performance of the cooling conduit coils 190 as a heat exchanger.

In preferred practice, the cooling conduit coils 190, the fins 250, and all other portions of the conduit 200 preferably are formed from stainless steel that is selected to be able to withstand thermal and "steam lock" shocks of the type that can be experienced when a flow of cooling water is initiated through the conduit 200 and its coils 190 when an annealing cycle switches from its "heating portion" to its "cooling portion."

Features of novelty also are deemed to reside in the method of annealing which obtains through use of the improved apparatus, as described above, to effect more rapid cooling from an annealing temperature. In tests, a prototype embodying the invention has been shown to be capable of cutting by as much as fifty percent the many hours required to cool a stack of sheet steel coils from an annealing temperature to near ambient temperature; and, the advantageous placement of cooling conduit coils at a mid-stack location has been shown to be particularly effective in concentrating the effect of cooling in the midstack vicinity which has always been the most difficult region of a stack of coils to cool inasmuch as heat energy dissipates far more readily from upper and lower end regions of the stack, leaving a concentration of heat energy at mid-stack. Cooling is expedited when its effect is concentrated at a mid-stack height by positioning the cooling conduit coils 190 to extend circumferentially about mid-stack portions of the stacked coils 162, 164, 166.

In preferred operation, the coils 162, 164, 166 are stacked substantially concentrically atop an annealing furnace base assembly 110 as is depicted in FIG. 1, and the described inner cover 120 is lowered over the stack 160 to a position where the depending rim 122 engages the seal 140 to define a treatment chamber 150 that is sealed from ambient atmosphere so that a nonoxidizing atmosphere can be maintained therein. After the coils 162, 164, 166 have been heated to and maintained at an annealing temperature for an appropriate length of time, the cooling part of the annealing cycle is begun. A pressurized flow of cooling fluid, typically cold water, is circulated through the coils 190 of the cooling conduit 200 as the base-carried fan 170 is operated to circulate gases within the treatment chamber 150. The circulating gases flow around, about and among the coils 162, 164, 166, and are cooled by coming into engagement with or by passing within close proximity to the cooled fins 250 and the cooled coils 190 of the cooling conduit 200.

The positioning of the cooling conduit coils 190 within an inwardly-facing recess defined by the enlarged diameter mid-height portion 128 of the inner cover 120 tends to concentrate the cooling effect within the midheight region of the stack 160 where cooling is most needed, and accomplishes this result without impeding proper gas circulation in the gas circulation space that is maintained between all elements of the inner cover 120 and the cylindrical outer surfaces of the stacked coils 162, 164, 166. Moreover, by recessing or "nesting" the cooling conduit coils 190 within the enlarged diameter mid-height region of the inner cover 120, the coils 190 and the fins 250 carried by the coils are protected from impact with the coils 162, 164, 166 as the inner cover 120 is lowered into and raised out of its operating position. Also, the array of vertically extending support bars 230 serves to protectively shield the cooling conduit coils 190 while securely supporting the coils 190 in a manner that will withstand the thermal shock that is incurred when cooling water is introduced into the coils 190 at the initiation of the cooling cycle.

Still another feature of utilizing an enlarged mid-height inner cover diameter to receive, mount and protect cooling conduit coils resides in the ease with which existing cylindrical inner covers can be retrofitted to incorporate the described cooling system. Central sections of existing inner covers can be cut away and either replaced with new, larger diameter central sections, or expanded in diameter (with the addition of several inches of steel plate to enhance circumference) to provide larger diameter central sections that will permit the described cooling coils 190 and their supports 230 to be installed—whereby, with relatively minimal expense and fuss, existing inner covers can be retrofitted to provide the features and advantages of the present invention.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the Invention. It is intended that the patent shall cover, by suitable expression in the appended claims, whatever features of patentable novelty exist in the invention disclosed.

What is claimed is:

1. Apparatus for cooling from an annealing temperature a mass of steel that includes at least one coil of sheet steel having a generally cylindrical outer surface and opposed, substantially flat sides, that is supported atop a base of an annealing furnace with the opposed sides of the coil extending substantially horizontally, comprising:

a) inner cover means for surrounding the mass of steel and for cooperating with the base of the annealing furnace to define a generally cylindrical treatment chamber sealed from ambient atmosphere within which gases of a nonoxidizing atmosphere may be circulated;

b) cooling conduit means connected to the inner cover means for being positioned within the treatment chamber to encircle at least one circumferentially extending portion of the cylindrical outer surface of said at least one coil at a distance separated therefrom by a space that also encircles said at least one portion, and with the cooling conduit means having inlet means and outlet means for the flow of coolant fluid through the cooling conduit means for cooling the cooling conduit means for cooling gases of the nonoxidizing atmosphere that circulate within the treatment chamber and through said space; and, c) protective means for minimizing damage to the cooling conduit means by minimizing contact of the cooling conduit means with the mass of steel when the inner cover means is positioned to extend about, and is withdrawn from extending about, the mass of steel.

2. The apparatus of claim 1 wherein the cooling conduit means includes at least one continuous helix coil of tubing with the inlet means and outlet means being connected to opposite ends thereof for ducting coolant fluid flow through the coil.

3. The apparatus of claim 1 wherein the protective means includes recess defining means for defining a circumferentially extending recess that extends about and faces toward the at least one portion of the cylindrical outer surface of said at least one coil for protectively enclosing at least portions of the cooling conduit means therein.

4. The apparatus of claim 3 wherein the inner cover means includes a substantially cylindrical central wall portion of the inner cover means that defines a back wall of the recess and has a first diameter, a substantially cylindrical upper wall portion of the inner cover means that extends upwardly from the recess and has a diameter less than the first diameter, a substantially cylindrical lower wall portion of the inner cover means that extends downwardly from the recess and has a diameter less than the first diameter, and end wall portions that provide transitions between the central wall portion and the upper and lower wall portions.

5. The apparatus of claim 4 wherein the end wall portions that provide transitions include oppositely tapered upper and lower truncated conical rings, with the upper ring being connected to the central wall portion and to the upper wall portion of the inner cover, and with the lower ring being connected to the central wall portion and the lower wall portion of the inner cover.

6. The apparatus of claim 3 additionally including conduit support means connected to the inner cover means for supporting the cooling conduit means to extend within said recess.

7. The apparatus of claim 6 wherein the conduit support means includes a plurality of vertically extending support bars circumferentially spaced within the circumferentially extending recess and connected to the cooling conduit means.

8. The apparatus of claim 6 wherein the cooling conduit means includes at least one continuous helix coil of tubing with the inlet means and outlet means being connected to opposite ends thereof for ducting coolant fluid flow through the coil.

9. The apparatus of claim 8 wherein the conduit support structure includes upstanding support means for extending substantially vertically at locations spaced along the circumferentially extending length of the recess for engaging the continuous helix coil of tubing at a plurality of spaced locations along the length of the helix coil to securely support the helix coil.

10. The apparatus of claim 1 wherein the inner cover means includes an upstanding, generally cylindrical steel structure, and the protective means includes an inwardly facing recess defined by an enlarged diameter mid-height portion of the generally cylindrical steel structure.

11. The apparatus of claim 1 wherein the mass of steel includes a plurality of coils of sheet steel arranged substantially concentrically one atop another with opposed, substantially flat sides of the coils extending substantially horizontally, wherein the cooling conduit means is positioned by the inner cover means to surround mid-height portions of the stack, and wherein the protective means includes inwardly facing recess means defined by the inner cover means for protectively receiving at least portions of the cooling conduit means therein.

12. The apparatus of claim 11 wherein the cooling conduit means includes heat exchange fin means for extending about a fluid circulation conduit that is contained within an inwardly facing recess defined by the recess means.

13. Apparatus for cooling from an annealing temperature a generally cylindrical stack of coils of sheet steel that each have a generally cylindrical outer surface and opposed, substantially flat sides, that are supported atop a base of an annealing furnace with opposed sides of each of the coils extending substantially horizontally, and with the coils of the stack extending substantially coaxially one atop another with an uppermost portion of the highest coil in the stack defining the height of the stack, comprising:

a) inner cover means for surrounding the stack of coils and for cooperating with the base of the annealing furnace to define a generally cylindrical treatment chamber sealed from ambient atmosphere within which gases of a nonoxidizing atmosphere may be circulated;

b) cooling conduit means connected to the inner cover means for being positioned within the treatment chamber to encircle at least one circumferentially extending portion of the cylindrical outer surface of at least one coil of the stack at a location mid-way along the height of the stack and at a distance separated from said at least one portion by a space that also encircles said at least one portion, and with the cooling conduit means having inlet means and outlet means for the flow of coolant fluid through the cooling conduit means for cooling the cooling conduit means for cooling gases of the nonoxidizing atmosphere that circulate within the treatment chamber and through said space; and, c) protective means for minimizing damage to the cooling conduit means by minimizing contact of the cooling contact means with the stack when the inner cover means is positioned to extend about, and is withdrawn from extending about, the stack.

14. The apparatus of claim 13 wherein the cooling conduit means includes at least one continuous helix coil of tubing with the inlet means and outlet means being connected to opposite ends thereof for ducting coolant fluid flow through the coil.

15. The apparatus of claim 13 wherein the protective means includes recess defining means for defining a circumferentially extending recess that extends about and faces toward the at least one portion of the cylindrical outer surface of said at least one coil for protectively enclosing at least portions of the cooling conduit means therein.

16. The apparatus of claim 15 wherein the inner cover means includes a substantially cylindrical central wall portion of the inner cover means that defines a back wall of the recess and has a first diameter, a substantially cylindrical upper wall portion of the inner cover means that extends upwardly from the recess and has a diameter less than the first diameter, a substantially cylindrical lower wall portion of the inner cover means that extends downwardly from the recess and has a diameter less than the first diameter, and end wall portions that provide transitions between the central wall portion and the upper and lower wall portions.

17. The apparatus of claim 15 additionally including conduit support structure connected to the inner cover means for supporting the cooling conduit means to extend within said recess.

18. The apparatus of claim 17 wherein the cooling conduit means includes at least one continuous helix coil of tubing with the inlet means and outlet means being connected to opposite ends thereof for ducting coolant fluid flow through the coil.

19. The apparatus of claim 18 wherein the conduit support structure includes upstanding support means for extending substantially vertically at locations spaced along the circumferentially extending length of the recess for engaging the continuous helix coil of tubing at a plurality of spaced locations along the length of the helix coil to securely support the helix coil.

20. The apparatus of claim 13 wherein the inner cover means includes an upstanding, generally cylindrical steel structure, and the protective means includes an inwardly facing recess defined by an enlarged diameter mid-height portion of the generally cylindrical steel structure.

21. The apparatus of claim 13 wherein the protective means includes inwardly facing recess means defined by the inner cover means for protectively receiving at least portions of the cooling conduit means therein.

22. The apparatus of claim 21 wherein the cooling conduit means includes heat exchange fin means for extending about a fluid circulation conduit that is contained within an inwardly facing recess defined by the recess means.

23. An annealing furnace for heating to an annealing temperature and for cooling from an annealing temperature a mass of steel that includes at least one coil of sheet steel having a generally cylindrical outer surface and opposed, substantially flat sides, that is supported atop a base of an annealing furnace with the opposed sides of the coil extending substantially horizontally, comprising:

a) generally cylindrical inner cover means for surrounding the mass of steel and for cooperating with the base of the annealing furnace to define a generally cylindrical treatment chamber sealed from ambient atmosphere within which gases of a nonoxidizing atmosphere may be circulated;

b) heating means for heating the mass of steel within the treatment chamber to a selected annealing temperature;

c) cooling means for cooling the mass of steel from the selected annealing temperature including cooling conduit means connected to the inner cover means for being positioned within the treatment chamber to encircle at least one circumferentially extending portion of the cylindrical outer surface of said at least one coil at a distance separated therefrom by a space that also encircles said at least one portion, and with the cooling conduit means having inlet means and outlet means for the flow of coolant fluid through the cooling conduit means for cooling the cooling conduit means for cooling gases of the nonoxidizing atmosphere that circulate within the treatment chamber and through said space; and, d) protective means for minimizing damage to the cooling conduit means by minimizing contact of the cooling conduit means with the mass of steel when the inner cover means is positioned to extend about, and is withdrawn from extending about, the mass of steel including an enlarged diameter mid-height region of the inner cover wherein the cooling means is protectively nested.

24. The annealing furnace of claim 23 wherein the cooling conduit means includes at least one continuous helix coil of tubing with the inlet means and outlet means being connected to opposite ends thereof for ducting coolant fluid flow through the coil.

25. The annealing furnace of claim 24 additionally including conduit support structure connected to the inner cover means for supporting the cooling conduit means to extend within said recess.

26. The annealing furnace of claim 25 wherein the conduit support structure includes upstanding support means for extending substantially vertically at locations spaced along the circumferentially extending length of the recess for engaging the continuous helix coil of tubing at a plurality of spaced locations along the length of the helix coil to securely support the helix coil.

27. The apparatus of claim 26 wherein the cooling conduit means includes heat exchange fin means for extending about a fluid circulation conduit that is contained within an inwardly facing recess defined by the recess means.

28. A method for cooling from an annealing temperature a mass of steel that includes at least one coil of sheet steel having a generally cylindrical outer surface and opposed, substantially flat sides, that is supported atop a base of an annealing furnace with the opposed sides of the coil extending substantially horizontally, comprising the steps of:

a) providing inner cover means for surrounding the mass of steel and for cooperating with the base of the annealing furnace to define a generally cylindrical treatment chamber sealed from ambient atmosphere within which gases of a nonoxidizing atmosphere may be circulated, with the inner cover means including recess defining means for defining a circumferentially extending recess that extends about and faces toward the at least one portion of the cylindrical outer surface of said at least one coil;

b) providing cooling conduit means connected to the inner cover means for being positioned within the treatment chamber, with at least portions of the cooling conduit means extending into the recess for being protectively enclosed therein, to encircle at least one circumferentially extending portion of the cylindrical outer surface of said at least one coil at a distance separated therefrom by a space that also encircles said at least one portion, and with the cooling conduit means having inlet means and outlet means for the flow of coolant fluid through the cooling conduit means for cooling the cooling conduit means for cooling gases of the nonoxidizing atmosphere that circulate within the treatment chamber and through said space; and, c) circulating coolant fluid through the cooling conduit means to cool cooling gases circulating within the treatment chamber to assist in cooling the mass of steel after the mass of steel has been heated to an annealing temperature.

29. The method of claim 28 wherein the step of providing cooling conduit means includes the step of providing at least one continuous helix coil of tubing with the inlet means and outlet means being connected to opposite ends thereof for ducting coolant fluid flow through the coil, and the step of circulating coolant fluid through the cooling conduit means includes introducing coolant fluid into the continuous helix coil of tubing through the inlet means and withdrawing coolant fluid from the helix coil of tubing through the outlet means.

30. The method of claim 29 wherein the step of providing cooling conduit means includes the steps of providing conduit support structure connected to the inner cover means for supporting the cooling conduit means to extend within said recess, and connecting the cooling conduit to the conduit support structure to securely support the cooling conduit means in the presence of thermal shock which occurs when coolant fluid is introduced into the coolant conduit means at the initiation of the step of circulating coolant fluid through the cooling conduit means.

* * * * *

UNITED STATES PATENT AND TRADEMARK OFFICE

CERTIFICATE OF CORRECTION

PATENT NO. : 5,961,322
DATED : October 5, 1999
INVENTOR(S) : Gary L. Coble

It is certified that error appears in the above-indentified patent and that said Letters Patent is hereby corrected as shown below:

Column 5, line 12, after "numeral" cancel "."

Column 5, line 33, after "Fig. 1" insert --may belong to a "single stack" furnace which employs only--

Column 7, line 64, cancel "Invention" and substitute --invention--

Claim 1, paragraph c), after "protective means" insert -- located at the inner wall of said inner cover means for protectively housing at least portions of said cooling conduit means--

Claim 13, paragraph c), after "protective means" insert -- located at the inner wall of said inner cover means for protectively housing at least portions of said cooling conduit means--

Claim 23, paragraph d), after "protective means" insert -- located at the inner wall of said inner cover means for protectively housing at least portions of said cooling conduit means--

Signed and Sealed this

First Day of May, 2001

*Attest:*

Nicholas P. Godici

NICHOLAS P. GODICI

*Attesting Officer*

*Acting Director of the United States Patent and Trademark Office*